United States Patent [19]

Meyersburg

[11] Patent Number: 5,035,339

[45] Date of Patent: Jul. 30, 1991

[54] UNIVERSAL SPRAYER CANISTER

[75] Inventor: Richard W. Meyersburg, Tenafly, N.J.

[73] Assignee: VMC Industries, Inc., Philadelphia, Pa.

[21] Appl. No.: 275,686

[22] Filed: Nov. 23, 1988

Related U.S. Application Data

[63] Continuation of Ser. No. 43,502, Apr. 28, 1987, abandoned.

[51] Int. Cl.[5] ..... B65D 1/16; B65D 1/42; B65D 41/06; B65D 41/00

[52] U.S. Cl. ..... 215/1 C; 215/100 R; 215/248; 220/91; 220/293; 220/672; 239/DIG. 17

[58] Field of Search ..... 215/248, 100 R, 1 C; 220/293, 301, 302, 91, DIG. 14, 672; 239/DIG. 14; 292/256, 257, 256.75

[56] References Cited

U.S. PATENT DOCUMENTS

| | | | |
|---|---|---|---|
| 110,757 | 1/1871 | Farnham | 215/284 |
| 533,282 | 1/1895 | Dunkley | 215/284 |
| 1,122,749 | 12/1914 | Haussler | 292/257 X |
| 1,583,927 | 5/1926 | Hersleb | 222/464 |
| 1,837,844 | 12/1931 | Wyzenbeek | 220/301 |
| 1,843,269 | 2/1932 | Capser | 220/325 |
| 2,145,077 | 1/1939 | Farr | 220/301 |
| 2,178,964 | 11/1939 | Hulse | 220/326 X |
| 2,323,618 | 7/1943 | Ottoson | 239/DIG. 14 X |
| 2,403,778 | 7/1946 | Zdanaitis | 220/301 |
| 2,508,597 | 5/1950 | Dalrymple | 220/325 X |
| 2,606,586 | 8/1952 | Hill | 150/55 |
| 2,622,770 | 12/1952 | Penno | 222/464 |
| 2,670,882 | 3/1954 | Best | 222/464 |
| 2,851,187 | 9/1958 | Hall | 220/91 |
| 3,035,623 | 5/1962 | Goetz | 215/100 R |
| 3,240,398 | 3/1966 | Dalton, Jr. | 222/464 X |
| 3,381,845 | 5/1968 | MacDonald | 220/301 |
| 3,401,842 | 9/1968 | Morrison | 222/464 X |
| 3,507,451 | 4/1970 | Johnson | 239/305 |
| 3,593,921 | 7/1971 | Boltic | 215/284 X |
| 3,714,967 | 2/1973 | Zupan et al. | 222/464 X |
| 3,942,680 | 3/1976 | Seeley et al. | 220/293 X |
| 4,151,929 | 5/1979 | Sapien | 220/404 |
| 4,166,431 | 9/1979 | Pickering | 220/82 R |

FOREIGN PATENT DOCUMENTS

| | | | |
|---|---|---|---|
| 2462000 | 3/1981 | France | 220/301 |

*Primary Examiner*—Sue A. Weaver

*Attorney, Agent, or Firm*—Panitch Schwarze Jacobs & Nadel

[57] ABSTRACT

A plastic disposable canister for use with a conventional paint spray gun. The canister is a cylinder having a closed bottom, an open top, and two diametrically opposed external stiffening ribs extending the height of the canister. The canister includes two diametrically opposed cover engaging members formed from the upper portions of the stiffening ribs for engagement with the most commonly available paint sprayers.

17 Claims, 5 Drawing Sheets

FIG. 5
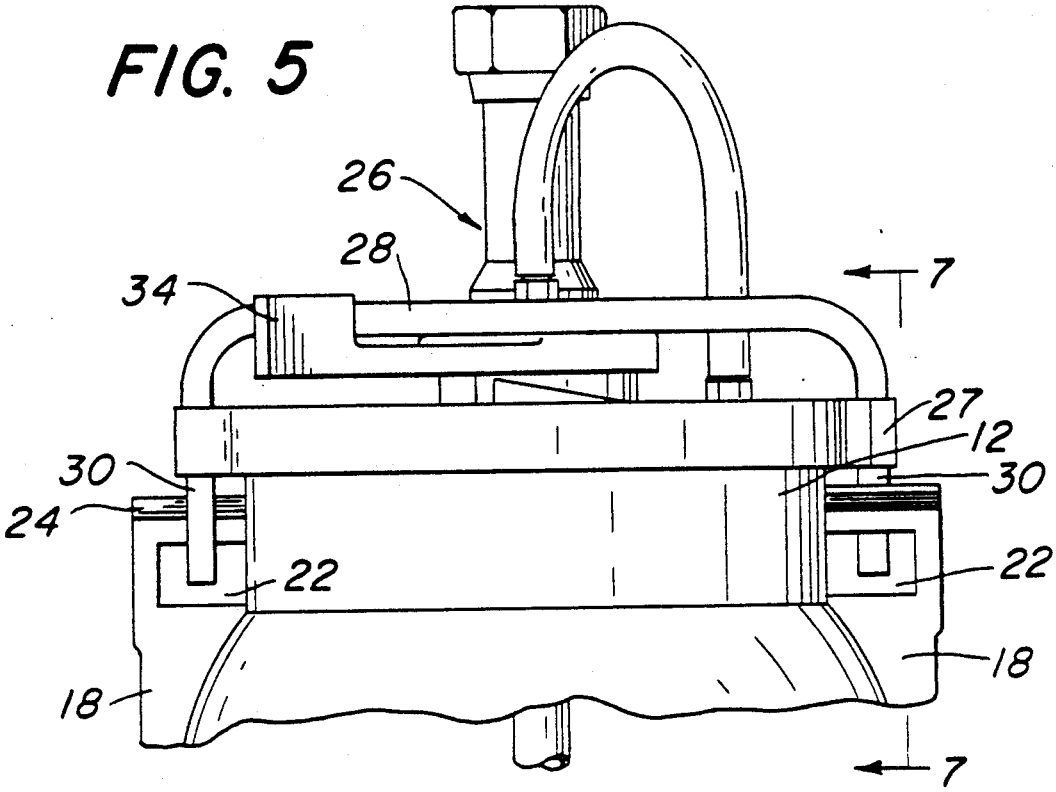
FIG. 6
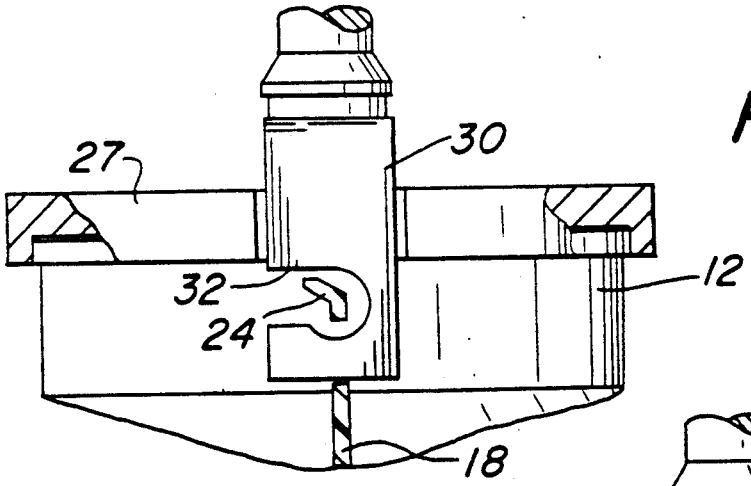
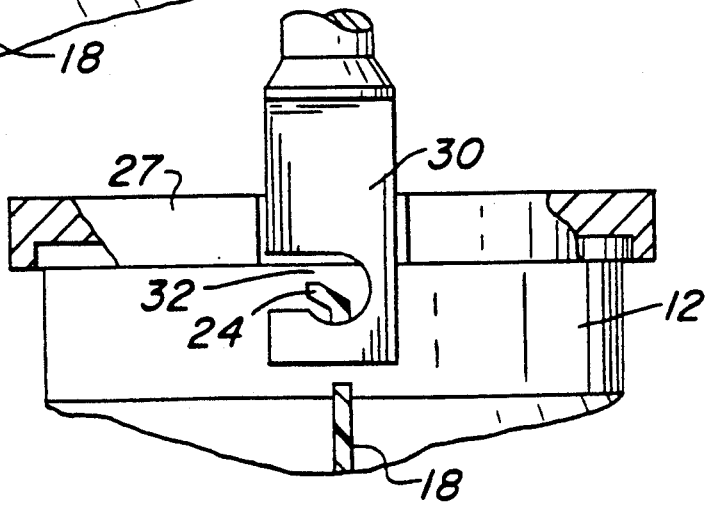
FIG. 7

FIG. 8
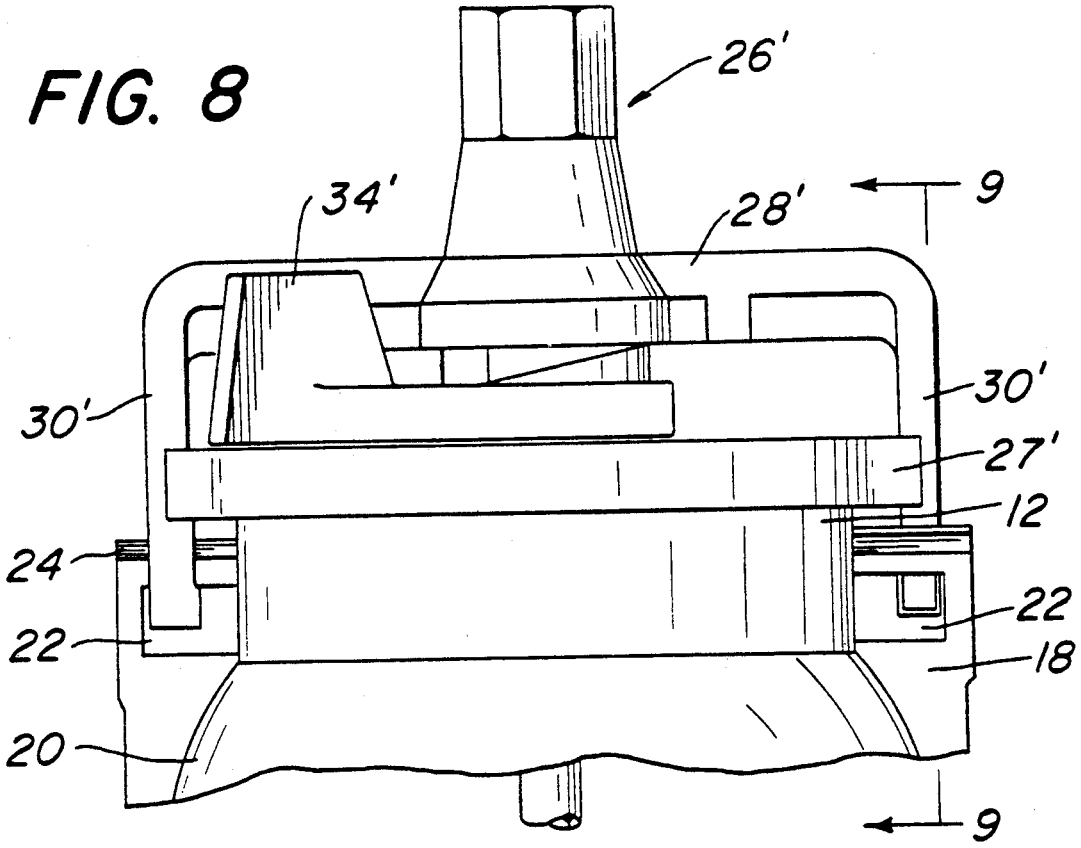
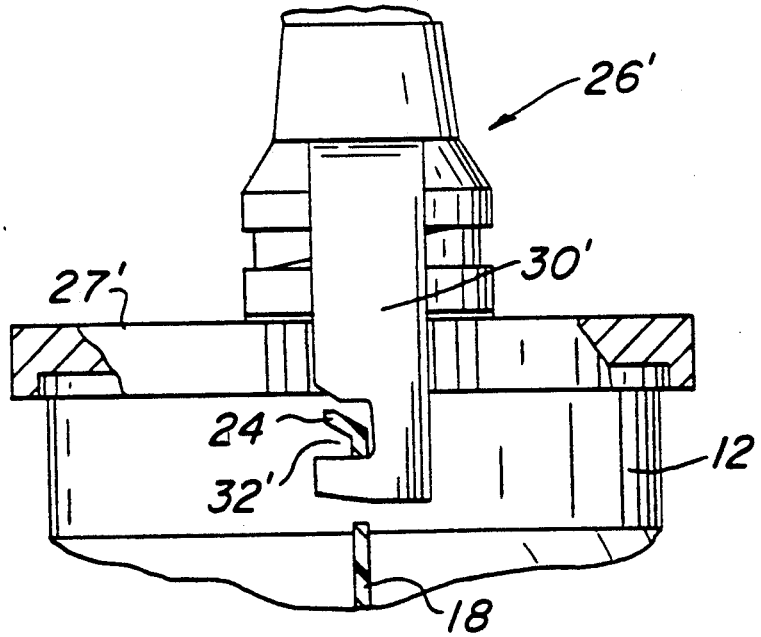
FIG. 9

FIG. 10
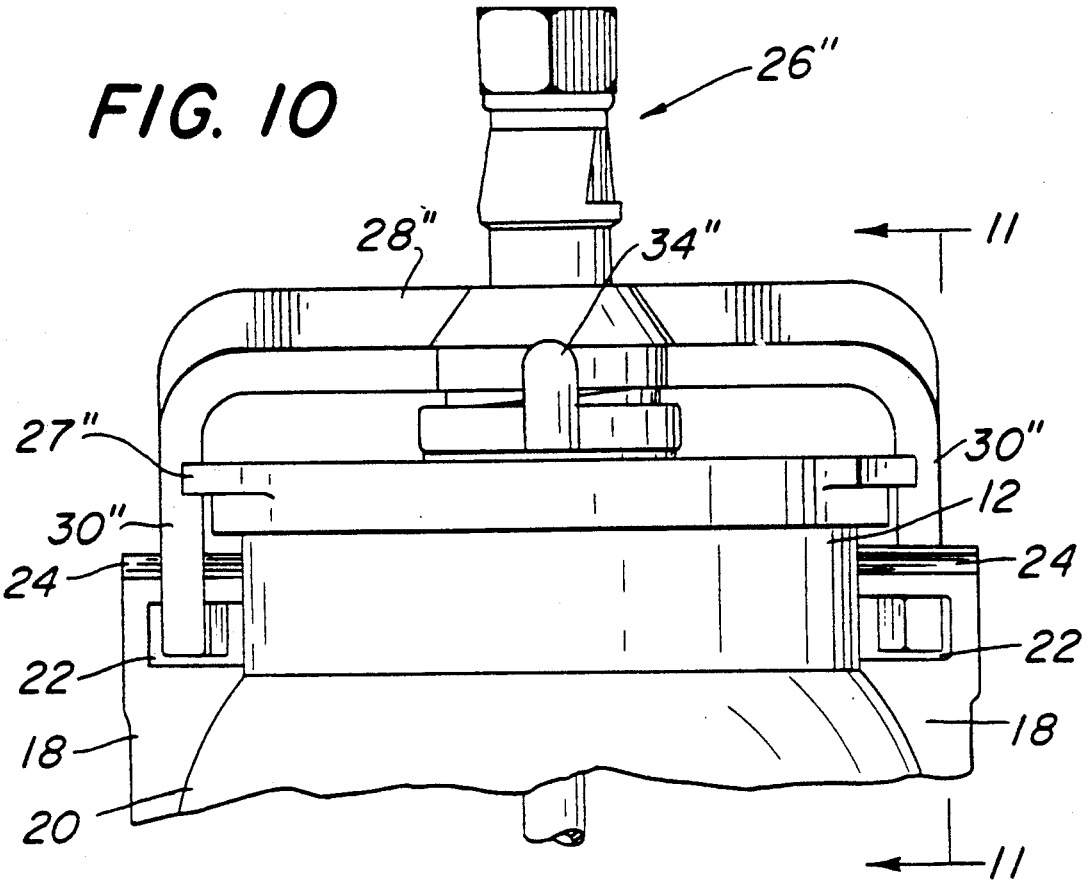
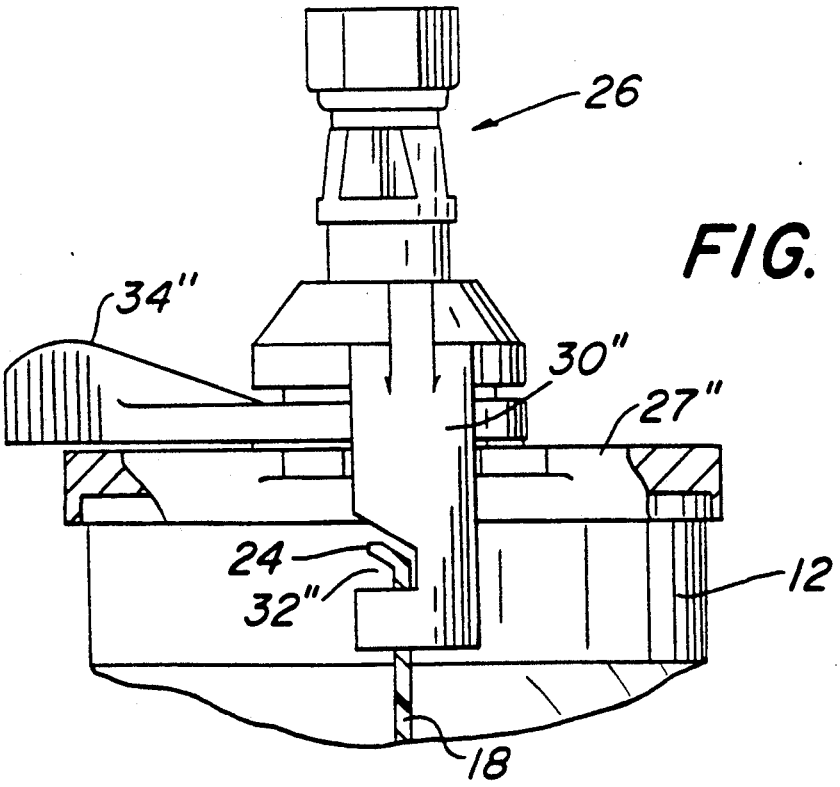
FIG. 11

UNIVERSAL SPRAYER CANISTER

This is a continuation of application Ser. No. 07/043,502, filed Apr. 28, 1987, now abandoned.

BACKGROUND OF THE INVENTION

The present invention relates to a universal plastic disposable canister to be used with spraying apparatus having a variety of different configurations. This invention is particularly suited for use with paint sprayers, although it is by no means so limited, and can be used with other sprayable liquids.

Paint sprayers which use metal canisters to hold the paint or lacquer to be sprayed are well known. The metal canisters are reusable and must be cleaned after every use, thereby increasing the time and labor of painting operations. In addition, it takes approximately a pint of solvent, e.g., paint thinner or turpentine, to clean a canister after every use. Solvents are considered hazardous waste and therefore must be disposed of carefully. These factors also add to the cost involved in the use of metal canisters with paint sprayers.

Disposable plastic containers for paint sprayers are known. See, e.g., U.S. Pat. No. 3,381,845. However, known disposable plastic containers are merely plastic copies of the metal container, using lugs projecting from opposite sides of the mouth of the container to engage a sprayer cover. They do not show the important features of the instant invention, explained in detail below.

SUMMARY OF THE INVENTION

The present invention is a canister molded of a plastic to include either high density polyethelene, high molecular weight polyethelene, polyvinylchloride or other suitable impact resistant plastic material. The preferred embodiment is a canister which is substantially cylindrical, having a closed base and one opening at the top typically having a diameter of approximately 3.472 inches. Ribs having dimensions approximately 0.100 of an inch wide and 0.125 of an inch deep protrude from diametrically opposing sides of the cylinder, and extend the vertical length of the canister from the base to the neck. At the neck, the ribs widen to form a rectangular opening which is reinforced on the upper portion by an angled extension of the rib. The rectangular opening is designed to receive hooked protrusions of a cover locking mechanism for a variety of paint sprayer apparatus.

The canister is preferably constructed by either extrusion blow molding or by injection molding of a plastic material and is designed to be used once and then disposed of. In addition, after the plastic canister is molded, the compression molded flashing which occurs at the seams, and which is normally trimmed away, is instead left on the canister to form strengthening ribs which reinforce the canister, enabling it to withstand the pressure applied to it when in use without collapsing.

Further, the wider top portion of the strengthening ribs, which protrudes from the neck of the canister, is shaped to form a rectangular opening with a reinforcing upper angled piece, also partly fashioned from the compression molded flashing. This angled piece enables the cover engaging means of the canister to withstand the full range of pressure that can be applied to it when sprayer covers are attached to the canister using these rectangular openings.

The distance between top of the rectangular opening and the lip at the top of the opening of the canister is approximately 0.529 of an inch. This distance was chosen so that there would be a sufficient depth to allow the plastic canister to be universally adapted to fit the three major types of sprayers presently on the market.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 5, 8 and 10 are enlarged fragmented views of the upper portion of the canister showing the attachment of the three different major types of paint sprayer covers.

FIG. 6 is a sectional view taken along line 7—7 in FIG. 5 showing the cover in FIG. 5 in an unlocked position.

FIG. 7 is a sectional view taken along the lines 7—7 in FIG. 5 showing the cover in FIG. 5 in a locked position.

FIG. 9 is a sectional view taken along lines 9—9 in FIG. 8 showing the cover in FIG. 8 in a locked position.

FIG. 11 is sectional view taken along lines 11—11 in FIG. 10, showing the cover in FIG. 10 in a locked position.

DESCRIPTION OF THE PREFERRED EMBODIMENT

Figure 1:
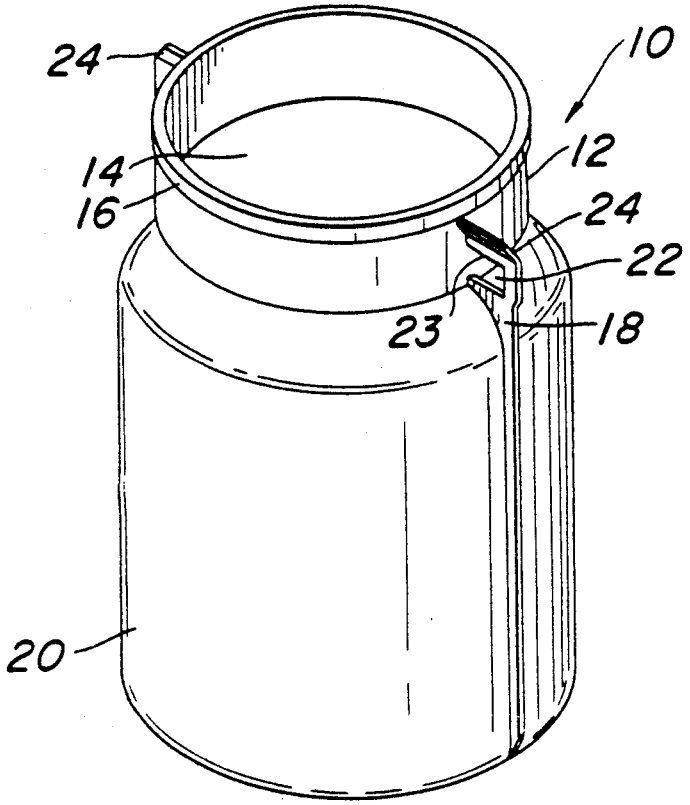
FIG. 1 is a perspective view showing a seam with the flashing forming a strengthening rib.
Figure 2:
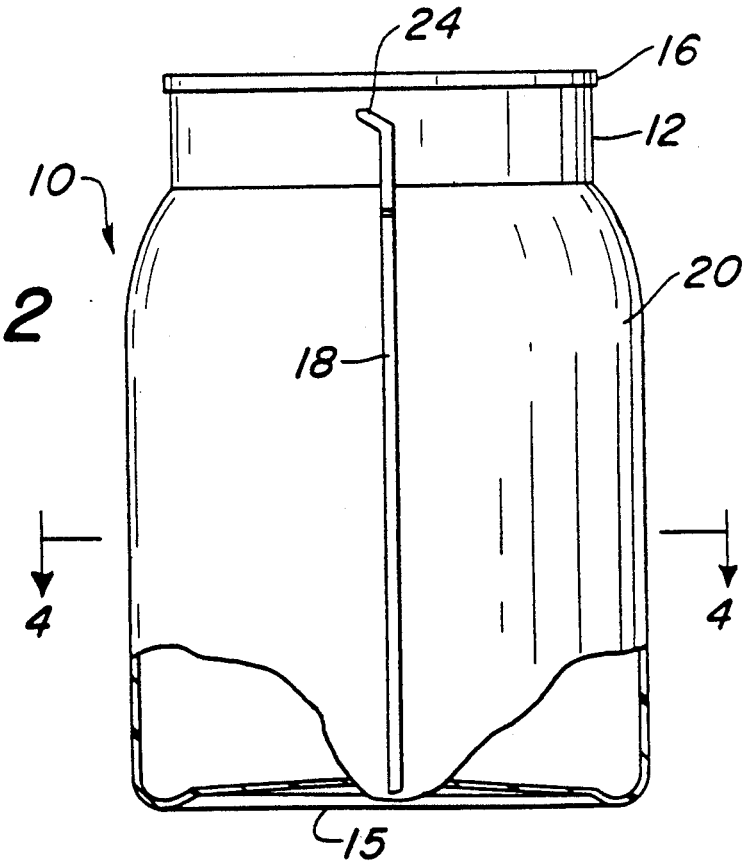
FIG. 2 is an elevational view with the lower portions of the canister partially broken away.

Referring now to the drawings, wherein like numerals indicate like elements, there is shown in FIGS. 1 and 2 a plastic canister 10 having a top opening 14 and a closed base 15. The outer wall 20 of the canister tapers into a reduced diameter neck 12 with a lip 16. A strengthening rib 18, made from the flashing left after the compression molding process, projects from outer wall 20 and extends vertically upward conforming to outer wall 20. At the neck 12, the rib widens and is molded to form a rectangular hole 22. Strengthening rib 18 terminates close to the top of neck 12 with an upper angled projection 24, to reinforce and give added strength to the top portion 23 of rectangular hole 22. This angled projection 24 will enable the cover engaging means of canister to withstand the clamping pressure exerted on the upper portion 23 of rectangular hole 22 when a sprayer cover is secured in place.

Figure 3:
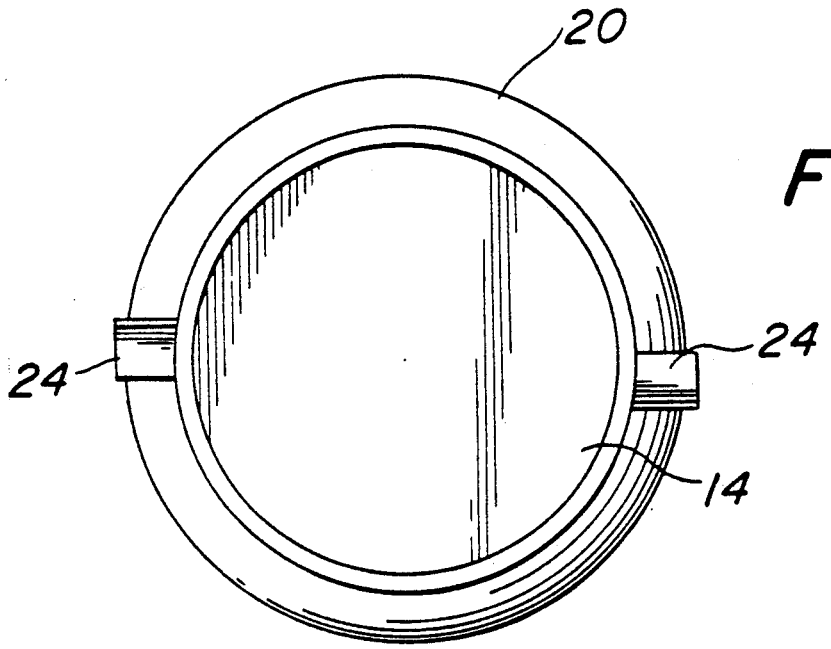
FIG. 3 is a top plan view.
Figure 4:
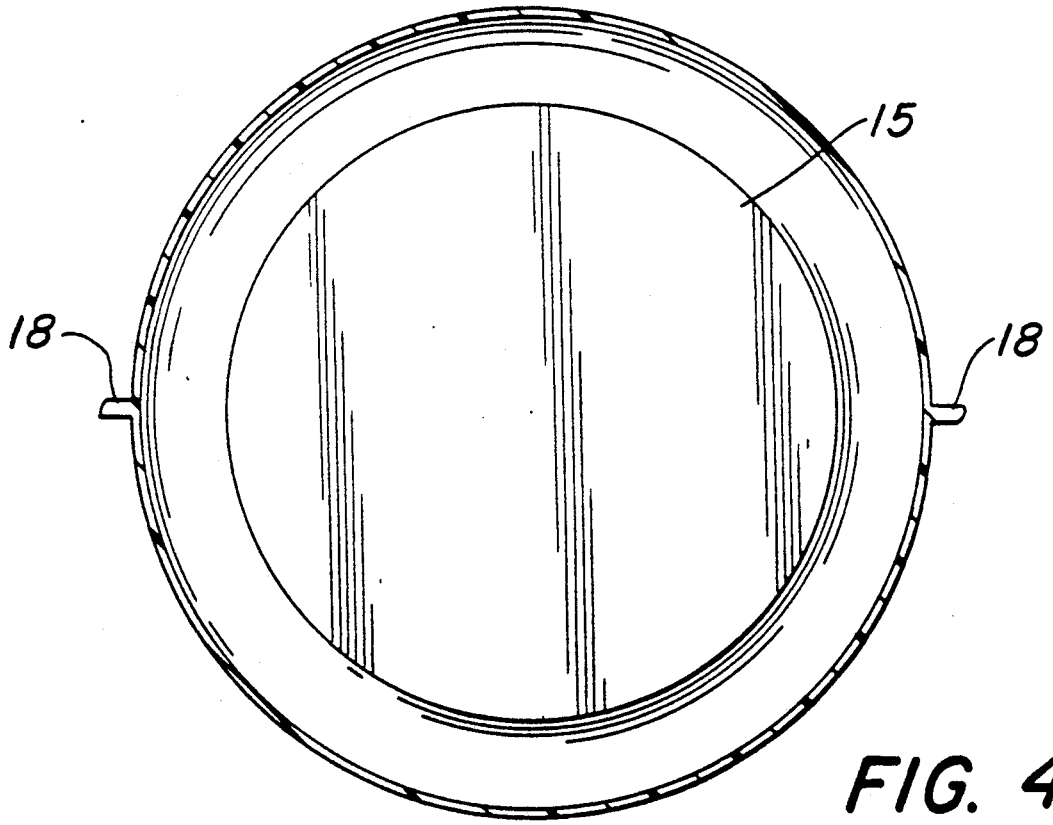
FIG. 4 is a sectional view taken along lines 4—4 in FIG. 2.

FIGS. 3 and 4 show the top opening 14 and the closed base 15 respectively.

FIGS. 5 through 7 show the top portion of the canister 10 to which a conventional paint sprayer closure 26 has been attached. The closure 26 is manufactured by Binks, one of the three major companies in the paint sprayer business. The closure 26 comprises a cover 27 attached to a yoke assembly 28. The yoke assembly 28 has downward sloping arms 30. Each arm 30 of the yoke assembly 28 has a horizontal slot 32 near its end.

The slot 32 allows the lower portion of the arm 30 to hook into rectangular hole 22.

Rotation of thumb bolt 34 lifts the yoke assembly 28 causing that portion of the arm 30 which is hooked into rectangular hole 22 to lift, thus applying pressure to the reinforcing upper angled projection 24, and at the same time forcing the cover 27 against the top of the canister 10 sealing it.

FIGS. 8 and 9 show the top portion of the canister 10 to which a conventional paint sprayer closure 26' has been attached. The closure 26' is manufactured by DeVilbiss, one of the three major companies in the paint sprayer business. The closure 26' comprises a cover 27' attached to a yoke assembly 28'. The yoke assembly 28' has downward sloping arms 30'. Each arm 30' of the yoke assembly 28' has a horizontal slot 32' near its end. The slot 32' allows the lower portion of the arm 30' to hook into rectangular hole 22. Rotation of the thumb bolt 34' lifts the yoke assembly 28' causing a portion of the arm 30' which is hooked into the rectangular hole 22 to lift, thus applying pressure to the reinforcing upper angled projection 24 and at the same time forcing the cover 27' against the top of the canister 10 sealing it.

FIGS. 10 and 11 show the top portion of the canister 10 which a conventional paint sprayer closure 26'' has been attached. The closure 26'' is manufactured by Sharpe, one of the three major companies in the paint sprayer business. The closure 26'' comprises a cover 27'' attached to a yoke assembly 28''. The yoke 28'' has downward sloping arm 30''. Each arm 30'' of the yoke assembly 28'' has a horizontal slot 32'' near its end. The slot 32'' allows the lower portion of arm 30'' to hook into rectangular hole 22. Rotation of the thumb bolt 34'' lifts the yoke assembly 28'' causing the portion of the arm 30'' which is hooked into the rectangular hole 22 to lift, thus applying pressure to the reinforcing upper angled projection 24 and at the same time forcing the cover 27'' against the top of the canister 10 sealing it.

As indicated, a particular advantage of the instant invention is its adaptability to each of the sprayer closures 26, 26' and 26''. In addition, it is sufficiently inexpensive to make so that it can be discarded when changing paint color or when a paint job is completed. This eliminates the time and labor involved in cleaning the conventional reusable canisters and eliminates the cost relating to the disposal of hazardous waste solvents.

The present invention may be embodied in other specific forms without departing from the spirit or essential attributes thereof and, accordingly, reference should be made to the appended claims, rather than to the foregoing specification, as indicating the scope of the invention.

What is claimed is:

1. A plastic canister for sprayers, said canister having a closed bottom end, and an open top end, and radially opposed cover engaging means integral with the outer surface of the canister adjacent the open top end, said cover engaging means each comprising a rib projecting outwardly from the canister and having an opening therethrough for receiving an engagement element of a sprayer, means for reinforcing that portion of the rib at the uppermost portion of the opening to withstand the clamping forces applied to the rib by the attachment of a sprayer cover apparatus to the canister.

2. The canister of claim 1 wherein the cover engaging means is fashioned from the flashing of the molding process for the canister.

3. The canister of claim 1 wherein the cover engaging means is positioned for universal use with the most widely available sprayer apparatus, wherein the opening comprises:

a rectangular hole for receiving a sprayer cover apparatus; and wherein the reinforcing means comprises:

an angled projection of plastic extending from the top of the rectangular hole for strengthening and reinforcing the upper portion of the rectangular hole to enable it to withstand the force applied when the cover apparatus is secured in place.

4. The canister of claim 1 wherein said rib extends substantially from the bottom to the top of said canister along the side thereof.

5. A canister for substantially universal use with sprayers of the type having a canister closure and canister engaging elements for securing a canister to the closure, said canister being plastic molded and having a closed bottom end, an open top end, and radially opposed engaging means on the outer surface of the canister adjacent the open top end thereof, said engaging means each comprising an elongated rib extending outwardly from the canister to be received by a respective one of the canister engaging elements of the sprayer, each of the ribs being fashioned from flashing molded integrally with the canister during molding of the canister, the rib extending elongatedly from an upper end located most proximal to the top open end of the canister at least generally towards the closed bottom end of the canister, the rib including a lower surface defined by an upper margin of an opening through the rib, the lower surface being positioned to be engaged by the respective canister engaging element for securing the canister to the closure.

6. The canister of claim 5, wherein said lower surface of each said rib is spaced in the order of about 0.529 inch below the open top end of the canister.

7. The canister of claim 5, wherein each canister engaging element comprises an arm having an opening therein facing in a given direction of relative rotation between the arm and the canister and a topmost portion of each said rib above the lower surface is angled from an axial direction of the canister in said given direction toward one of said arm openings.

8. The canister of claim 7, wherein each said rib comprises a lower portion extending from the topmost portion towards the closed bottom end in a direction generally parallel to the axial direction of the canister.

9. The canister of claim 8, wherein each said rib extends from the upper end downwardly to substantially the closed bottom end of the canister.

10. An integrally molded plastic canister for use with sprayers of the type having a canister closure and a pair of canister engaging arms for securing a canister to the closure, each engaging arm having an opening therein facing in a given direction of rotation of the canister engaging arms for rotationally receiving the canister, said canister having a closed bottom end, and open top end, and a pair of radially opposed ribs extending outwardly from the surface of the canister and formed from flashing of the molded canister, each said rib including an angled projection at the upper end thereof and a hole through the rib immediately below said angled projection for reception of a respective one of the canister engaging arms, each angled projection being angled away from an upwardly axial direction of the canister extending toward the open top end of the canister in said given rotational direction to be received within the opening in the engaging arm when the canister is engaged with the arms, each angled projection having a lower surface positioned to be engaged by the respective engaging arm for securing the canister to the closure, each said rib extending from the top of the respective angled projection downwardly along the canister for reinforcing the canister to withstand the force applied when the canister is secured to the closure.

11. A disposable molded plastic canister for substantially universal use with sprayers of the type having a canister closure and canister engaging elements for securing a canister to the closure, said disposable canister having a closed bottom end, an open top end, radially opposed outwardly projecting ribs molded integrally with the canister, said ribs defining radially opposed engaging means on the outer surface of the canister adjacent the open top end thereof, said engaging means each comprising an angled projection extending outwardly from the canister, said angled projection including a lower portion extending generally parallel to the axis of the canister, the lower edge of which comprises a lower surface of the projection and an upper portion angled upwardly from said lower portion in a given rotational direction with respect to the canister to be received by a respective one of the canister engaging elements of a sprayer, each lower surface being positioned to be engaged by the respective canister engaging element for securing the canister to the closure, said angled projection being angled for accommodating its reception by the canister engaging element and for strengthening and reinforcing the projection to withstand the force applied when the canister is secured to the closure, and said projecting ribs having a hole therethrough, the upper margin of which is defined by said lower surface of the respective angled projection, the angled projection comprising the uppermost portion of the respective rib.

12. A canister for substantially universal use with sprayers of the type having a canister closure and canister engaging elements for securing a canister to the closure, said canister having a closed bottom end, an open top end, and radially opposed engaging means on the outer surface of the canister adjacent the top end thereof, said engaging means each comprising an elongated projection extending outwardly from the canister to be received by a respective one of the canister engaging elements of the sprayer, the elongated projection having an upper end located most proximal to the top end of the canister and the projection extending elongatedly from the upper end towards the closed bottom end of the canister, the elongated projection including a lower surface provided by an opening extending through the elongated projection, the lower surface being positioned to be engaged by the respective canister engaging element for securing the canister to the closure.

13. The canister of claim 12, wherein a first portion of each projection located between the lower surface and the open top end is angled along the canister in a direction between an axial direction and a circumferential direction of the canister.

14. The canister of claim 13 wherein each projection further comprises a second portion extending down along the canister at an axial direction between the first portion and the lower surface.

15. The canister of claim 12 wherein the projection extends along the canister beyond the lower surface towards the closed bottom end of the canister.

16. The canister of claim 15 wherein the opening is a closed perimeter hole extending through the projection.

17. The canister of claim 15 wherein each elongated projection has a total height in an axial direction of the canister exceeding a total length of the elongated projection in a circumferential direction of the canister.

* * * * *